United States Patent [19]

Niven, Jr.

[11] Patent Number: 4,522,096

[45] Date of Patent: Jun. 11, 1985

[54] DICING APPARATUS FOR SHEET MATERIAL

[75] Inventor: Benjamin F. Niven, Jr., Winston-Salem, N.C.

[73] Assignee: R. J. Reynolds Tobacco Company, Winston-Salem, N.C.

[21] Appl. No.: 505,414

[22] Filed: Jun. 16, 1983

[51] Int. Cl.[3] ..... B26D 7/20

[52] U.S. Cl. ..... 83/408; 241/3; 241/223; 241/236

[58] Field of Search ..... 83/408; 241/3, 101.4, 241/223, 236, 261; 131/311, 322, 327

[56] References Cited

U.S. PATENT DOCUMENTS

| | | | |
|---|---|---|---|
| 2,150,192 | 3/1939 | Sander | 241/236 |
| 3,713,358 | 1/1973 | Honeycutt et al. | 83/408 |
| 3,769,866 | 11/1973 | Pietrucci et al. | 83/408 |
| 4,426,044 | 1/1984 | Butler | 241/236 |

*Primary Examiner*—Frank T. Yost
*Assistant Examiner*—Hien H. Phan
*Attorney, Agent, or Firm*—Joseph E. Root, III

[57] ABSTRACT

A method and apparatus are provided to cut sheet material into quadrilateral pieces. The sheet material first is slit lengthwise into ribbons; then a swing assembly lays the ribbons onto a cutting bed, where circular knives cut them transversely into quadrilateral pieces. The swing assembly has a fixed end adjacent the slitting apparatus, and a free end that describes a reciprocating arc over the cutting bed.

4 Claims, 3 Drawing Figures

DICING APPARATUS FOR SHEET MATERIAL

BACKGROUND OF THE INVENTION

This invention relates to cutting apparatus, and more particularly to apparatus for dicing continuous sheet material into relatively small, quadrilateral pieces.

Some arts related to continuous sheet formation require minimal processing of the sheet material after it is formed. Others require substantial alteration of the material to convert it to a usable configuration. Reconstituted tobacco is manufactured by processes analagous to the paper-making art, and the product emerges in a continuous sheet, which must then be cut into small pieces approximately the size and shape of tobacco strips.

Conventionally, cutting apparatus consists of two sets of knives. Slitter knives, located immediately downstream from the sheet drying station, slice the sheet longitudinally. The resulting ribbons are then cut transversely by a reel cutter, fabricated much like a large reel-type lawnmower blade. Generally, this apparatus is difficult to maintain, as the blades are relatively inaccessible. Consequently, the blades often become gummy, reducing their efficiency and producing uneven cuts. Also this device inherently produces a high level of dust and fines, leading to added costs and reduced output. Morever, this design is limited in width, making it difficult to adapt to modern high-width drying equipment.

An improved apparatus is disclosed by Honeycutt in U.S. Pat. No. 3,713,358. In that device, sheet material first is slit and then cross-lapped onto a conveyor moving transverse to the previous direction of travel by a traversing vertical conveyor. The end of this traversing conveyor adjacent the slitter knives pivots, and the other end oscillates above the transverse conveyor. Another set of slitter knives at the end of the transverse conveyor cuts the cross-lapped material into parallelogram-shaped pieces.

This device offers improved performance over the conventional method, but at the price of increased space requirements to accommodate the transverse conveyor. Also, the preferred embodiment teaches the use of vacuum means to hold material on the traversing conveyor; this system entails relatively high energy requirements and results in the traversing conveyor being bulky.

Thus, the tobacco industry remains in need of apparatus to cut reconstituted tobacco, without increasing space or energy requirements over conventional methods.

SUMMARY OF THE INVENTION

The broad object of this invention is to provide an improved method and apparatus for cutting sheet material.

Another object of the present invention is a method and apparatus for cutting reconstituted tobacco into relatively small, quadrilateral pieces.

Yet another object of this invention is to provide an improved method and apparatus for cutting reconstituted tobacco that requires the same or less operating space and energy consumption as conventional apparatus.

Still another object of the invention is a method and apparatus for cutting reconstituted tobacco requiring little maintenance and producing smooth cuts, thus reducing scrap and dust.

These and other objects are accomplished by the present invention. The sheet material first is slit into ribbons by a set of knives. The ribbons then are fed into a vertical swing conveyor, the end of which describes an arc, laying the material on a horizontal cutting bed. There, an array of circular knives, whose axes are parallel to the sheet direction of travel, dices the ribbons into quadrilateral pieces, which fall through the array to a conveying means for further processing, or into a storage container.

DETAILED DESCRIPTION OF A PREFERRED EMBODIMENT

Figure 1:
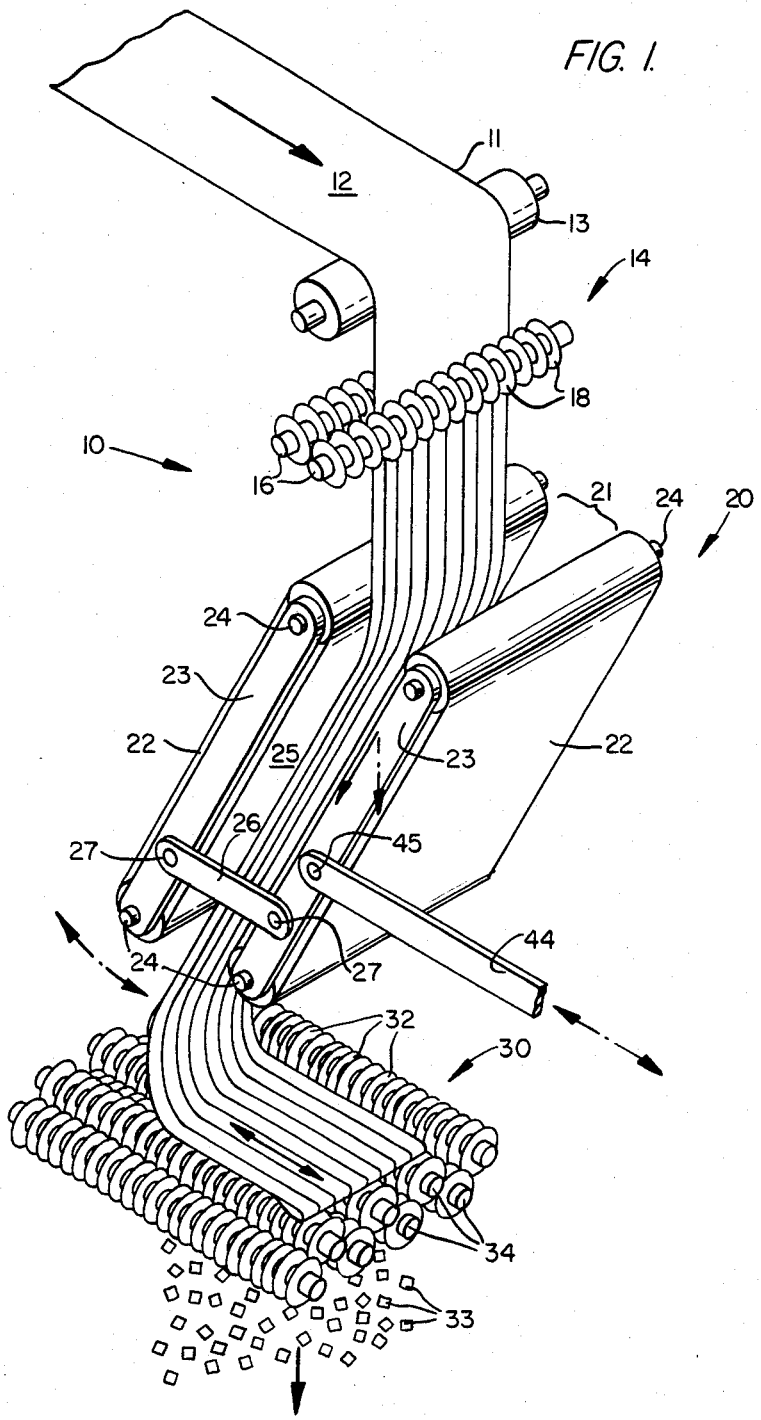
FIG. 1 is a pictorial of an embodiment of the invention.

An embodiment 10 of the present invention, positioned at the output end of a reconstituted tobacco manufacturing process, is shown in FIG. 1. A sheet 12 of reconstituted tobacco is carried from the drying apparatus (not shown) on a belt or similar suitable conveying means 11, terminating at a roller 13. It should be noted that the term "reconstituted tobacco" as used herein encompasses any smoking product manufactured in sheet form, and may include tobacco, tobacco substitute, or a combination of both ingredients.

At the end of the belt, the sheet is engaged by slitter assembly 14. This assembly may employ any of a number of known means for longitudinally separating the sheet into ribbons. It is preferred to pass the sheet through an array of opposed circular knives 18, mounted on two shafts 16 situated on either side of the sheet path. Opposing blades overlap slightly and counterrotate, drawing the material through a nip point to insure a complete cut. Both shafts are conventionally powered, and rotate at sufficient revolutions per minute, so that tip velocity approximately equals sheet speed. The slitter assembly may be mounted on the same level as the belt, but it is preferred to place it immediately below the end of the belt, so that the sheet falls into the nip of the blades. The sheet is slit into ribbons 19 whose width (and, hence, the number of blades) may be chosen based upon the desired dimensions of the final product. The embodiment shown uses 14 blades per shaft to produce ribbons 3 inches wide.

Figure 2:
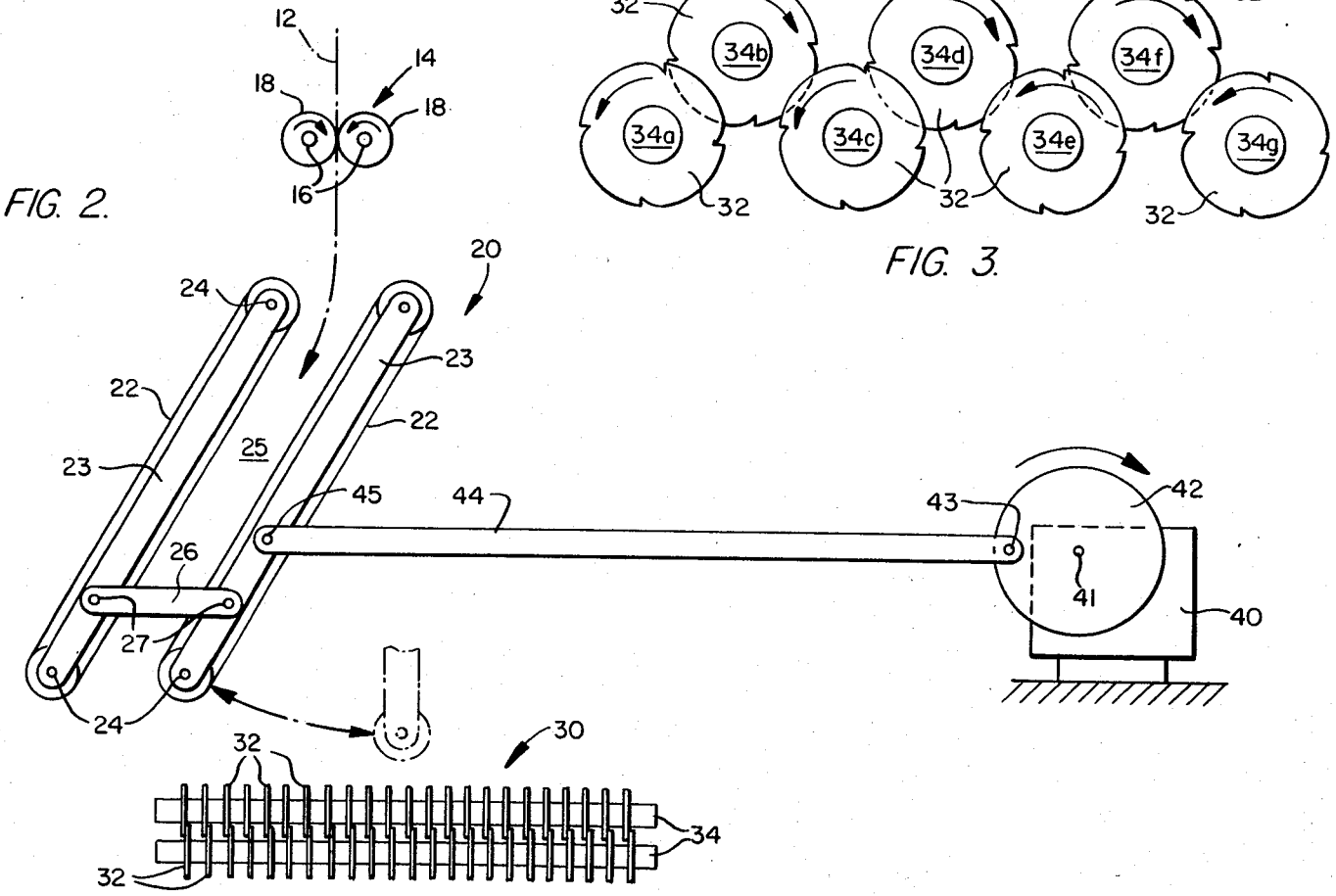
FIG. 2 is a side view of the invention, including a reciprocating drive means.

After being slit, the ribbons fall into the mouth 21 of swing assembly 20. As shown, this assembly consists of two endless belt conveyors 22 carried on rollers 24, the belts mounted vertically and parallel to one another. The rollers are journaled on struts 23, which hold the rollers in spatial relation. (FIG. 2). The rollers rotate opposite one another, so that the carrying surfaces 25 of both conveyors (those surfaces closest to the other conveyor) move in the same direction (downward). The upper roller of each conveyor is fixed, leaving the lower end free to pivot. Links 26 are pivotally fixed to pins 27 on both the struts, maintaining a fixed spacing between carrying surfaces, as seen in FIG. 2. The conveyors are powered by conventional means (not shown). Design criteria are discussed in detail below.

Although the embodiment depicted employs powered belt conveyors in the swing assembly, it should be noted that non-powered means could be used. For example, flat surfaces could be substituted for the belt conveyors shown. It has been discovered, however, that optimum operation occurs if the ribbons are urged downward, using the design described above.

The free end of the swing assembly is driven in reciprocating angular motion. Drive means may be, for example, an electric motor 40 having a wheel 42 mounted on its shaft 41, with a link 44 pivotally connected to pins on the periphery of the wheel and a strut (43 and 45, respectively).

Variations will be apparent to those in the art. Mounting details of the swing conveyor also will be apparent to those in the art, and are not depicted. If desired, a spring system, chosen to respond to the natural frequency of the system, may be included in the mounting arrangement.

Directly below the swing conveyor is the cutting bed 30, where circular knives 32 dice the ribbons transversely into quadrilateral pieces 33, which fall through the bed into conveying or storage means (not shown). (FIG. 1). The circular knives are mounted on shafts 34 to form blade arrays aligned parallel to the sheet direction of travel, so that the blades themselves are perpendicular to that axis.

Figure 3:
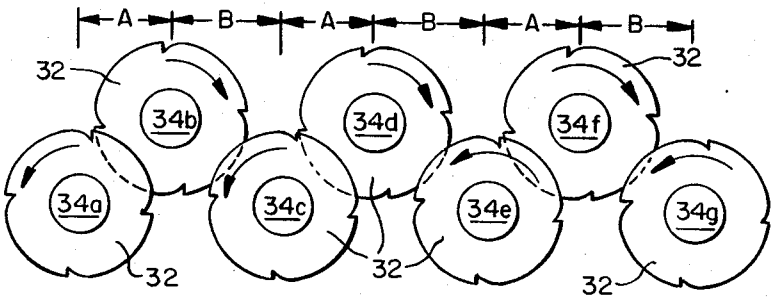
FIG. 3 is a detailed front view of a portion of the cutting bed.

As shown, arrays are staggered on two levels (FIG. 3). Blades on the upper levels rotate opposite to those below. Also, portions of the upper blades overlap the lower blades. Thus, some overlap areas, e.g., area A, FIG. 3, are divergent—the blades tend to push material out of the blade nip; other areas, such as area B, are convergent—blades tend to pull material into the nip. Cutting occurs primarily in convergent areas, where ribbons pass through a nip point. As ribbons fall onto the bed, material entering a divergent area is moved across a blade and into a convergent area. It has been found that best results are achieved by making the divergent areas A smaller than the convergent areas B, thus increasing the speed with which material is cut. This result can be achieved by increasing blade overlap in the divergent areas through, for example, spacing shafts 34 such that upper level arrays are not centered between lower level arrays, but rather are off center. Thus, as seen in FIG. 3, shaft **34*b* is positioned closer to shaft 34*a* than to shaft 34*c*; the divergent zone overlap is thereby increased and the convergent zone overlap decreased. Also, serrations 36** may be provided on each blade to aid in pulling material into the blade nip. Four serrations, approximately ½" (1.2 cm) long and ¼" (0.6 cm) deep have proved sufficient.

The embodiment shown employs eight arrays, each carrying 24 circular knives of 10" (25.4 cm) diameter. Rotational speed of the knives is kept at a relatively slow level (10 rpm being typical) to allow material to settle onto the upper level of knives before being cut. Also, slow speed minimizes fines. Based on the objective of duplicating the size of tobacco strips, spacing between knives was chosen as 2" (5.8 cm).

Obviously, several design parameters of the cutting bed may be varied by those skilled in the art. For example, a single level of knives could be employed, albeit at reduced effectiveness. Also, varying knife spacing or orientation would alter the shape of the final product.

Operation of the apparatus proceeds as follows. Reconstituted tobacco merges from the dryer in a sheet 12 carried on an endless belt 11. Sheet speeds typically are set in the range 300–500 feet per minute (90–100 meters per minute), with speeds of up to 1,000 feet (300 m.) per minute expected from newly evolving drying apparatus. The sheet moves over the end of the belt, at roller 15, and falls downward into the nip of the slitter assembly 14. There, slitter blades 16 separate the sheet longitudinally into ribbons 18. The ribbons then enter the mouth 21 of swing assembly 20. The lower of the two carrying surfaces 25 makes contact with the sheet, and the belt 22 propels it downward. The free end of the swing assembly travels in a reciprocating arc, driven so that its average tip velocity approximately equals the sheet speed. This criterion is necessary to allow the swing conveyor to lay out the sheet smoothly. Of course, the tip decelerates to zero at the top of each swing, then accelerates to a midpoint velocity greater than sheet speed, but this effect merely results in material bowing up at the top of the swing and the bow being pulled flat as the conveyor arcs downward. From this criterion, one can derive the design details of the swing conveyor. As will be readily appreciated by those in the art, the conveyor length, arc, and frequency are related to tip velocity. This relation can be satisfied in a number of combinations, but the embodiment shown in FIG. 1, envisions a sheet speed, and thus a conveyor tip velocity, of about 300 feet (91 m.) per minute, and a swing conveyor about 60" (1.5 m.) long, swinging through an arc of about 30° at about one cycle per second. Also, it is preferred to separate the carrying surfaces by about 5 inches (12.7 cm).

As the ribbons are laid out on the cutting bed, they are sliced transversely by the circular knives 32, either by direct cutting action or by being drawn into the nip of the upper and lower blade arrays. The resulting pieces 33 fall through the bed and may be collected for further processing by any convenient means.

This invention enables the production of approximately square or rectangular pieces of reproducible size. Prior art devices either presented cutting consistency problems (the reel-type cutter) or were limtied to parallelogram shapes (the cross-lap device). Also, it offers the advantage of considerable reduction in apparatus and space, as well as energy requirements, over the cross-lap device. Maintenance needs are easily met, as individual blade arrays easily are removed for sharpening; also, the absence of a complicated vacuum system reduces the likelihood of breakdown compared to the cross-lap device, as well as reducing energy consumption. Thus, this invention offers improved results over all prior art apparatus.

Those skilled in the art will be able to adapt this invention to differing situations. As discused, specific design parameters of the swing assembly, the slitter assembly and the cutter bed may be chosen to fit particular circumstances. These and other variations may be made without departing from the spirit of the invention, as defined by the claims that follow.

I claim:

1. Apparatus for cutting continuous sheet material into quadrilateral pieces, comprising:

means for longitudinally slitting the sheet into continuous ribbons;

a cutting bed, including a first plurality of spaced parallel powered shafts defining a first cutting array, a second plurality of spaced parallel powered shafts defining a second cutting array, said first and second plurality of shafts oriented parallel to said ribbons and said first cutting array being arranged to lie in a plane vertically spaced from a plane defined by said second cutting array, each of said shafts carrying thereon a plurality of circular blades spacedly affixed thereto; and swing assembly means interposed between said slitting means and said cutting bed, for receiving said continuous ribbons and lapping said ribbons atop said cutting bed.

2. The cutting apparatus of claim 1, wherein said swing assembly means includes two spaced powered conveying means in parallel relation to one another, disposed adjacent said slitting means such that said ribbons are received between said spaced conveying means;

the ends of said spaced conveying means adjacent said slitting means being fixed in position and the opposite ends of same being free to pivot adjacent said transverse cutting means; and drive means connected to said spaced conveyors for impelling said conveyors in reciprocating arcuate motion.

3. The cutting apparatus of claim 2, wherein said spaced conveyors are endless belt conveyors.

4. The cutting apparatus of claims 3 or 1, wherein said slitting means is at least two spaced parallel arrays of circular blades fixed to powered shafts.

* * * * *